US009309897B2

(12) United States Patent
Hashimoto et al.

(10) Patent No.: US 9,309,897 B2
(45) Date of Patent: Apr. 12, 2016

(54) AXIAL-FLOW FLUID MACHINERY, AND VARIABLE VANE DRIVE DEVICE THEREOF

(75) Inventors: Shinya Hashimoto, Tokyo (JP); Takuro Kameda, Tokyo (JP); Kenichi Arase, Tokyo (JP)

(73) Assignee: MITSUBISHI HITACHI POWER SYSTEMS, LTD., Kanagawa (JP)

( * ) Notice: Subject to any disclaimer, the term of this patent is extended or adjusted under 35 U.S.C. 154(b) by 737 days.

(21) Appl. No.: 13/559,972

(22) Filed: Jul. 27, 2012

(65) Prior Publication Data

US 2013/0108415 A1 May 2, 2013

(30) Foreign Application Priority Data

Nov. 2, 2011 (JP) ..... 2011-241390

(51) Int. Cl.
*F04D 29/059* (2006.01)
*F04D 29/56* (2006.01)
*F01D 17/16* (2006.01)

(52) U.S. Cl.
CPC ..... *F04D 29/563* (2013.01); *F01D 17/162* (2013.01); *F04D 29/059* (2013.01)

(58) Field of Classification Search
CPC ..... F04D 29/46; F04D 29/56; F04D 29/563; F04D 29/059; F01D 17/162
See application file for complete search history.

(56) References Cited

U.S. PATENT DOCUMENTS 3,504,952 A * 4/1970 Farmer ..... 384/57
3,990,809 A 11/1976 Young et al.
4,035,101 A 7/1977 Glenn
4,130,375 A 12/1978 Korta
7,300,245 B2 * 11/2007 Bouru ..... 415/147
7,938,620 B2 * 5/2011 Bouru ..... 415/160
8,834,103 B2 * 9/2014 Hirokawa et al. ..... 415/160
2007/0292264 A1 12/2007 Bouru

FOREIGN PATENT DOCUMENTS

CH 558 477 A 1/1975
EP 0 527 593 A2 2/1993
GB 2 301 867 A 12/1996
JP 63-151999 U 10/1988

(Continued)

OTHER PUBLICATIONS

International Search Report of PCT/JP2012/069370, date of mailing date Nov. 6, 2012.
Written Opinion of PCT/JP2012/069370, date of mailing date Nov. 6, 2012.
Japanese Office Action dated Oct. 7, 2014, issued in Japanese Patent Application No. 2011-241390 ( 6 pages).

(Continued)

*Primary Examiner* — Craig Kim
*Assistant Examiner* — Brian P Wolcott
(74) *Attorney, Agent, or Firm* — Westerman, Hattori, Daniels & Adrian, LLP

(57) ABSTRACT

A variable vane drive device includes a movable ring disposed at an outer circumferential side of a casing of an axial-flow compressor and having an annular shape, four ring support mechanisms disposed at intervals in a circumferential direction of the movable ring and rotatably supporting the movable ring around a rotor, and a link mechanism for connecting the movable ring to a variable vane such that a direction of the variable vane is varied by rotation of the movable ring. The ring support mechanisms have inner rollers, outer rollers, and roller support bases for rotatably supporting the inner rollers and the outer rollers in a state in which the movable ring is sandwiched between the inner roller and the outer rollers.

7 Claims, 6 Drawing Sheets

(56) References Cited

FOREIGN PATENT DOCUMENTS

| | | | |
|---|---|---|---|
| JP | 5-199704 | A | 8/1993 |
| JP | 2002-005096 | A | 1/2002 |
| JP | 2006-170209 | A | 6/2006 |
| JP | 2007-332970 | A | 12/2007 |
| JP | 2010-001821 | A | 1/2010 |

OTHER PUBLICATIONS

Extended European Search Report dated Mar. 4, 2015, issued in corresponding European Patent Application No. 12845065.7 (6 pages).

* cited by examiner

AXIAL-FLOW FLUID MACHINERY, AND VARIABLE VANE DRIVE DEVICE THEREOF

TECHNICAL FIELD

The present invention relates to an axial-flow fluid machine including a rotor at which a plurality of blades is installed and variable vanes, and a variable vane drive device thereof.

This application claims priority to and the benefit of Japanese Patent Application No. 2011-241390 filed on Nov. 2, 2011, the disclosures of which are incorporated by reference herein.

BACKGROUND ART

In a gas turbine or a turbo freezing machine, an axial-flow compressor, which is one type of axial-flow fluid machinery, is used to compress a gas. This type of axial-flow fluid machine sometimes includes a plurality of variable vanes disposed around a rotor in an annular shape, and a variable vane drive device configured to change directions of the variable vanes.

As disclosed in the following Patent Document 1 for example, the variable vane drive device includes a movable ring, a ring support mechanism, and an actuator. The movable ring is disposed at the outer circumferential side of a casing and has an annular shape. The ring support mechanism rotatably supports the movable ring. The actuator rotates the movable ring. The ring support mechanism has two first rollers and one second roller. The first rollers are disposed on the downside of the casing and an outer circumferential side of the movable ring at an interval in a circumferential direction of the movable ring. The second roller is disposed on the downside of the casing and an inner circumferential side of the movable ring at an interval from the two first rollers in the circumferential direction of the movable ring.

RELATED ART DOCUMENT

Patent Document

[Patent Document] Japanese Unexamined Patent Application, First Publication No. 2010-1821

SUMMARY OF THE INVENTION

Problems to be Solved by the Invention

In an axial-flow compressor, pressure of a gas gradually increases as it flows downstream, and thus the temperature of the gas also increases. For this reason, in a startup process or a shutdown process of the axial-flow compressor, a thermal expansion difference is generated between the casing and the movable ring due to a temperature difference between the casing which is in direct contact with the gas and the movable ring. Specifically, in the start process of the axial-flow compressor, since a temperature increase of the casing is rapid compared with the movable ring, the diameter of the casing with respect to the movable ring is relatively increased.

In the technique disclosed in Patent Document 1, even when an axis of the movable ring coincides with an axis of the casing before starting, since the diameter of the casing with respect to the movable ring is relatively increased during the start process of the axial-flow compressor, a relative position between an upper portion of the movable ring and an upper portion of the casing varies even though a relative position between a lower portion of the movable ring and a lower portion of the casing does not vary. That is, a position of the axis of the movable ring with respect to the axis of the casing is deviated.

When the position of the axis of the movable ring with respect to the axis of the casing is deviated, vane angles of the plurality of variable vanes become uneven according to the deviation amount.

That is, in the technique disclosed in Patent Document 1, the vane angles of the plurality of variable vanes become uneven in a process in which an operating state of the axial-flow fluid machine changes.

In consideration of the problems of the related art, the purpose of the present invention is to provide an axial-flow fluid machine and a variable vane drive device thereof that are capable of always uniformizing vane angles of a plurality of variable vanes regardless of an operating state.

Means for Solving the Problems

In order to accomplish the above-mentioned purpose, there is provided a variable vane drive device of an axial-flow fluid machine which comprises a rotor having a plurality of blades, a casing which rotatably houses the rotor, and a plurality of variable vanes annularly arranged around the rotor on the inside of the casing. The variable vane drive device of the axial-flow fluid machine includes: a movable ring disposed at an outer circumferential side of the casing and having an annular shape; a plurality of ring support mechanisms which is disposed at intervals along a circumferential direction of the movable ring and rotatably supports the movable ring around the rotor; a rotary drive mechanism which rotates the movable ring around the rotor; and a link mechanism which connects the movable ring to the variable vane such that an angle of the variable vane is varied by rotation of the movable ring, wherein each of the plurality of ring support mechanisms includes: an inner roller disposed at an inner circumferential side of the movable ring; an outer roller which is disposed at an outer circumferential side of the movable ring, the movable ring being sandwiched between the inner roller and the outer roller; and a roller support base which rotatably supports the inner roller and the outer roller around an axis parallel to the rotor in a state in which the movable ring is sandwiched between the inner roller and the outer roller.

In a startup process or a shutdown process of the axial-flow fluid machine, a thermal expansion difference is generated between the casing and the movable ring due to a temperature difference between the casing which is in direct contact with a gas and the movable ring. In the variable vane drive device according to an aspect of the present invention (hereinafter referred to as the variable vane drive device of the present invention), since the movable ring is sandwiched between the inner rollers and the outer rollers of the plurality of ring support mechanisms, a contact state between the movable ring and all of the inner rollers and all of the outer rollers corresponding to the movable ring is maintained regardless of an operating state of the axial-flow fluid machine. Accordingly, according to the variable vane drive device of the present invention, positional deviation of an axis of the movable ring with respect to an axis of the casing can be prevented, and vane angles of the plurality of variable vanes can always be uniformized regardless of the operating state of the axial-flow fluid machine.

Here, in the variable vane drive device of the axial-flow fluid machine, each of the plurality of ring support mechanisms preferably has a center distance adjustment mechanism which adjusts a distance between the axis of the inner roller and the axis of the outer roller.

In this case, the center distance adjustment mechanism is a mechanism that varies at least one axis position of one roller of the inner roller and the outer roller, and comprises a rotary shaft that rotatably supports the one roller, wherein the rotary shaft may include: a roller attachment portion to which the one roller is rotatably attached around the axis of the one roller; and a supported portion which forms a cylindrical shape around an eccentric axis deviated from the one axis and is rotatably supported by the roller support base around the eccentric axis.

As described above, as the center distance adjustment mechanism is provided, the movable ring can be securely sandwiched between the inner rollers and the outer rollers. Accordingly, according to the variable vane drive device of the present invention, the positional deviation of the axis of the movable ring with respect to the axis of the casing can be more securely prevented.

In addition, in the variable vane drive device of the axial-flow fluid machine, the rotary drive mechanism may have an actuator having a driving end that linearly reciprocates, and a link mechanism which connects the driving end to the movable ring.

In the variable vane drive device of the present invention, as described above, even when the thermal expansion difference is generated between the casing and the movable ring, in order to prevent the positional deviation of the axis of the movable ring with respect to the axis of the casing, the movable ring is sandwiched between the inner rollers and the outer rollers of each of the plurality of ring support mechanisms. For this reason, when the thermal expansion difference is generated between the casing and the movable ring, a portion of the movable ring which is not sandwiched between the inner rollers and the outer rollers is bent according to the operating state of the axial-flow fluid machine. If the portion, which is not sandwiched between the inner rollers and the outer rollers, is directly connected with the driving end of the actuator, as the driving end follows the bending, an unnecessary load is applied to the actuator. On the other hand, in the variable vane drive device of the present invention, the driving end of the actuator can be connected to the movable ring via the link mechanism, and thereby the bending of the drive ring can be absorbed by the link mechanism. Accordingly, according to the variable vane drive device of the present invention, the unnecessary load can be prevented from being applied to the actuator.

In addition, in the variable vane drive device of the axial-flow fluid machine, four or five ring support mechanisms may be provided.

When the number of ring support mechanisms with respect to the movable ring is very large, reaction forces of the respective rollers increase due to the bending of the movable ring. Specifically, from a structural point of view, since stiffness of a beam is in reverse proportion to a cube of a distance between two points supporting the beam, as described in the present invention, when the number of ring support mechanisms is increased and the distance between the ring support mechanisms is reduced, reaction forces of the respective rollers are increased in proportion to the cube of the distance. Accordingly, when the number of ring support mechanisms is increased, the reaction forces of the respective rollers significantly increase, and thus the stiffness and the strength of the rotary shafts or the roller support bases of the respective rollers should be significantly enhanced. For this reason, it is preferable that four or five ring support mechanisms be provided for each of the movable ring.

In addition, the axial-flow fluid machine according to the present invention for solving the problems includes: the variable vane drive device; the rotor having the plurality of blades; a casing that rotatably houses the rotor; and a plurality of variable vanes annularly disposed around the rotor on the inside of the casing.

In the axial-flow fluid machine according to the present invention, since the variable vane drive device is provided, the positional deviation of the axis of the movable ring with respect to the axis of the casing can be prevented, and vane angles of the plurality of variable vanes can be always uniformized regardless of the operating state of the axial-flow fluid machine.

Effects of the Invention

According to the present invention, even when a thermal elongation difference is generated between the casing and the movable ring, since the movable ring is sandwiched between the inner roller and the outer roller at each of the plurality of ring support mechanisms, positional deviation of the axis of the movable ring with respect to the axis of the casing can be prevented.

Therefore, according to the present invention, vane angles of the plurality of variable vanes can be always uniformized regardless of the operating state of the axial-flow fluid machine.

MODES FOR CARRYING OUT THE INVENTION

Hereinafter, an embodiment of an axial-flow fluid machine according to the present invention will be described in detail with reference to the accompanying drawings.

Figure 1:
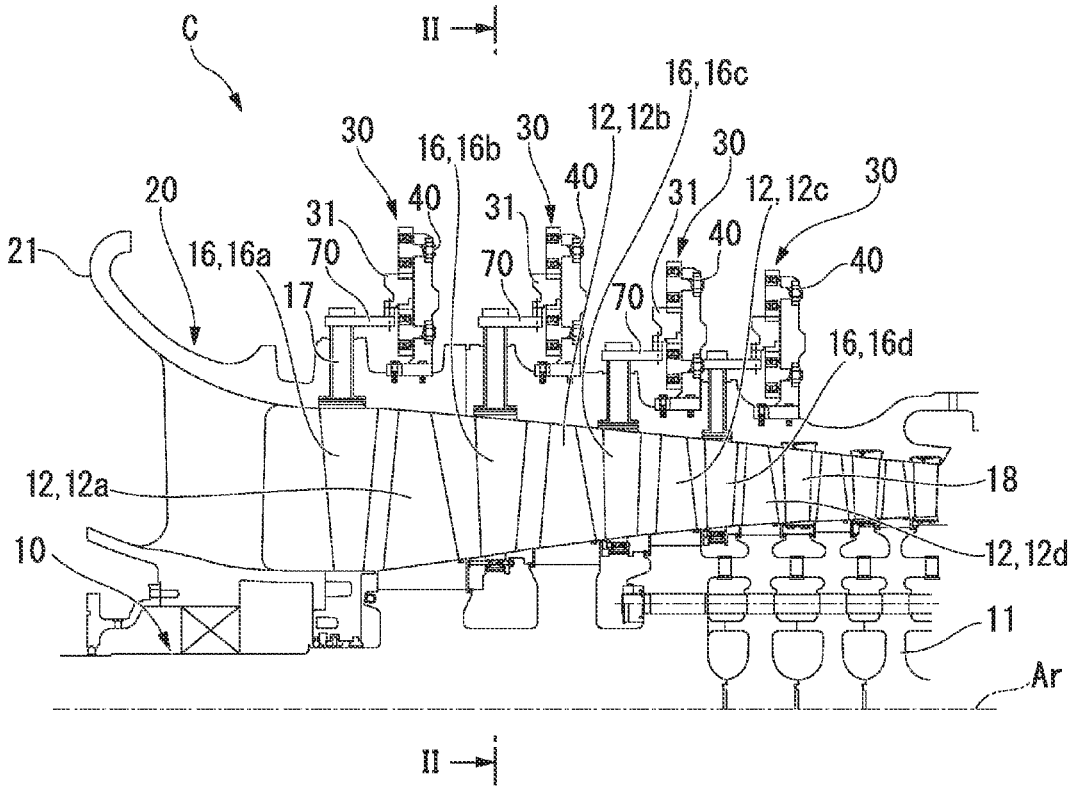
FIG. 1 is a cut-out side view of major part of an axial-flow compressor according to an embodiment of the present invention.

As shown in FIG. 1, the axial-flow fluid machine of this embodiment, which is an axial-flow compressor C, includes a rotor 10, a casing 20, and vanes 16 and 18. The rotor 10 includes a plurality of blades 12. The casing 20 rotatably covers the rotor 10. The plurality of vanes 16 and 18 is disposed around the rotor 10 in an annular shape.

The rotor 10 includes a rotor main body 11, and the plurality of blades 12. The rotor main body 11 is formed by stacking a plurality of rotor discs. The plurality of blades 12 extends in a radial direction from each of the plurality of rotor discs. That is, the rotor 10 has a multi-stage blade structure. The rotor 10 is rotatably supported by the casing 20 around an axis of the rotor main body 11 (hereinafter referred to as a rotor axis Ar).

A suction port 21 for taking in external air is formed at one side of the casing 20 in a direction of the rotor axis, and an ejection port (not shown) for ejecting a compressed gas is formed at the other side.

Among the plurality of blades 12, the plurality of blades 12 fixed to the rotor disc closest to the suction port 21 constitutes a first blade stage 12*a*, and the plurality of blades 12 fixed to the rotor disc, which is next to the rotor disc closest to the suction port at the ejection port side, constitutes a second blade stage 12*b*. Subsequently, the plurality of blades 12 fixed to the respective rotor discs installed at the ejection port side constitutes a third blade stage 12*c*, a fourth blade stage 12*d*, etc.

The plurality of vanes 16 and 18 is disposed in an annular shape around the rotor 10 at the suction port 21 side of the respective blade stages 12*a*, 12*b* etc. Here, the plurality of vanes 16 disposed at the suction port 21 side of the first blade stage 12*a* constitutes a first vane stage 16*a*, and the plurality of vanes 16 disposed at the suction port 21 side of the second blade stage 12*b* constitutes a second vane stage 16*b*. Subsequently, the plurality of vanes 16 disposed at the suction port 21 side of the respective blade stages 12*c*, 12*d*, etc. installed at an ejection port 22 side constitutes a third vane stage 16*c*, a fourth vane stage 16*d*, etc.

In this embodiment, among the respective vane stages, the respective vanes 16 constituting the first vane stage 16*a* to the fourth vane stage 16*d* form the variable vanes, and the vanes 18 constituting a fifth and subsequent stages form fixed vanes. Accordingly, hereinafter, the respective vanes 16 constituting the first vane stage 16*a* to the fourth vane stage 16*d* are referred to as variable vanes 16, and the first vane stage 16*a* to the fourth vane stage 16*d* are referred to as variable vane stages 16*a* to 16*d*.

Each of the variable vanes 16 is fixed to a vane rotary shaft 17 passing through the casing 20 from an inner circumferential side to an outer circumferential side, and fixed along a surface formed by the vane rotary shaft 17. Accordingly, as the variable vanes 16 are rotated with the vane rotary shaft 17, a direction (angle) of the variable vane 16 is varied.

Figure 2:
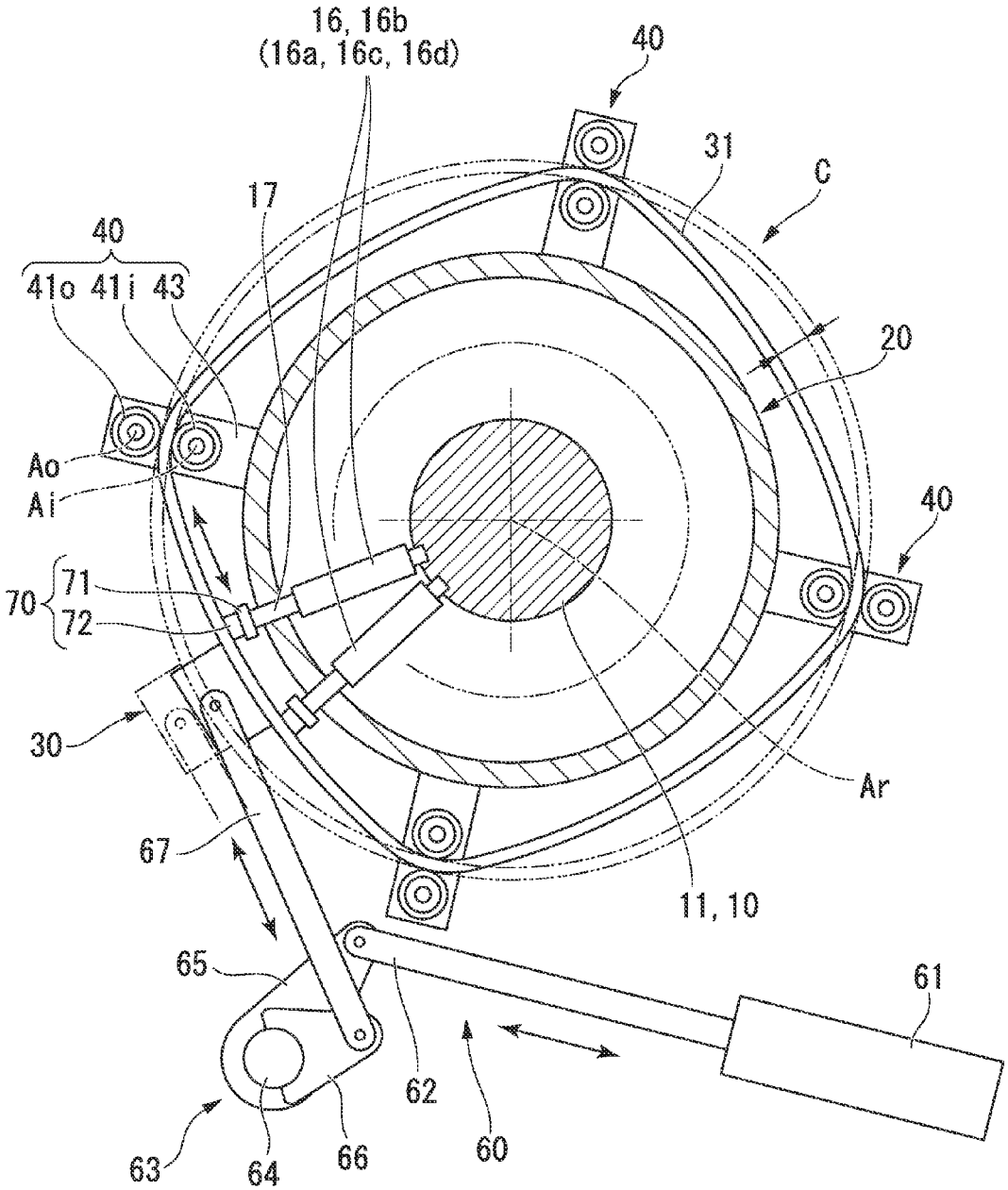
FIG. 2 is a schematic view taken along line II-II of FIG. 1.
Figure 3:
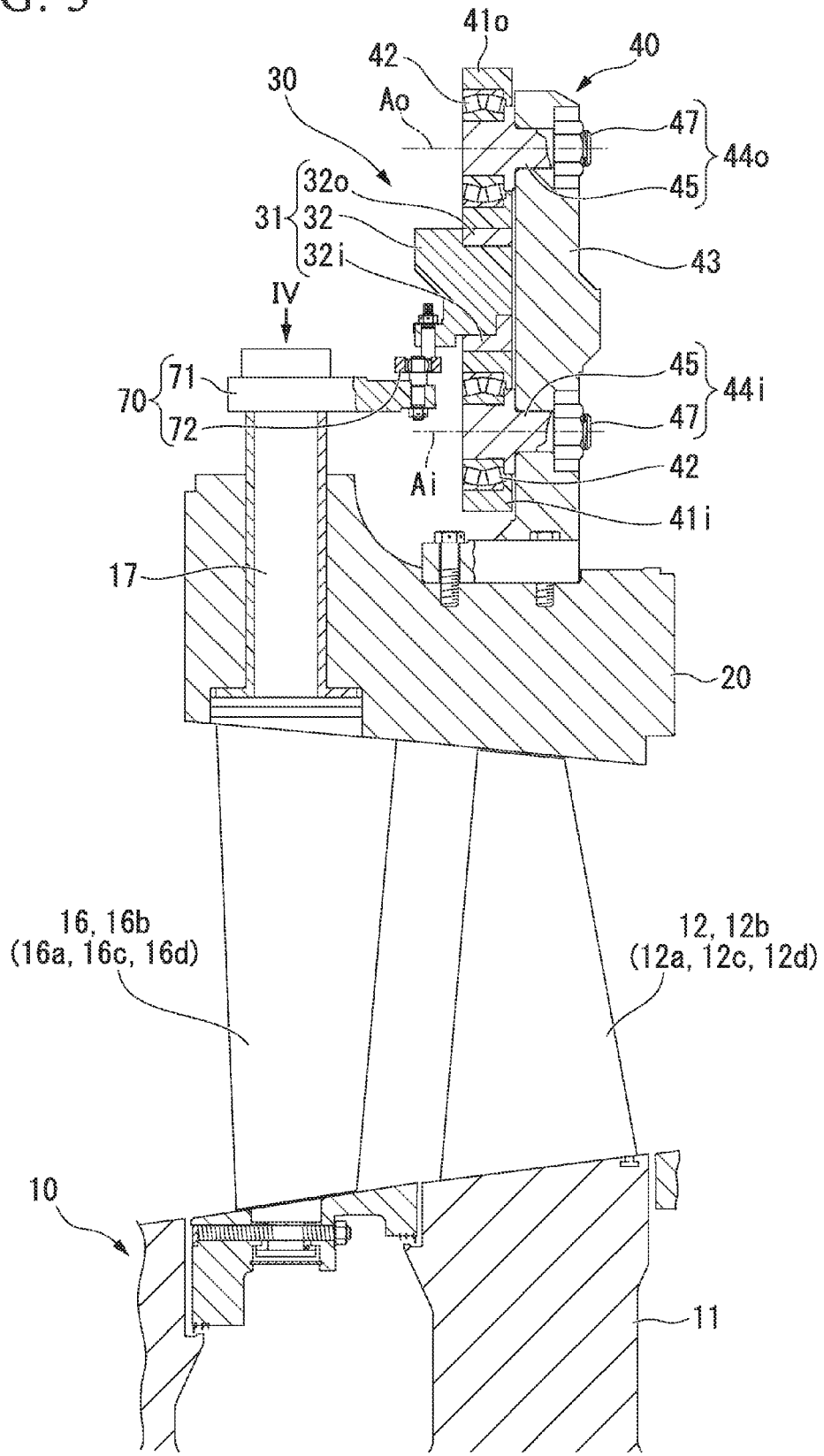
FIG. 3 is a cross-sectional view of a movable ring and a ring support mechanism according to the embodiment of the present invention.

As shown in FIGS. 1 to 3, the axial-flow compressor C of the present embodiment further includes a variable vane drive device 30 at each of the variable vane stages 16*a* to 16*d* to vary directions of the variable vanes 16 of each of the variable vane stages 16*a* to 16*d*. Each of the variable vane drive devices 30 includes a movable ring 31, a ring support mechanism 40, a rotary drive mechanism 60, and a ring-blade link mechanism 70. The movable ring 31 is disposed at the outer circumferential side of the casing 20 and has an annular shape. The plurality of ring support mechanisms 40 is disposed at intervals in the circumferential direction of the movable ring 31, and rotatably supports the movable ring 31 around the rotor axis Ar. The rotary drive mechanism 60 rotates the movable ring 31 around the rotor axis Ar. The ring-blade link mechanism 70 connects the movable ring 31 and the variable vane 16 such that the direction of the variable vane 16 is varied by rotation of the movable ring 31.

As shown in FIG. 2, the rotary drive mechanism 60 includes an actuator 61 and a drive-ring link mechanism 63. The actuator 61 is installed such that a driving end 62 linearly reciprocates. The drive-ring link mechanism 63 connects the driving end 62 to the movable ring 31. The drive-ring link mechanism 63 includes a link rotary shaft 64, a first link piece 65, a second link piece 66, and a third link piece 67. The link rotary shaft 64 is parallel to the rotor axis Ar. The first link piece 65 has one end portion coupled to the driving end 62 of the actuator 61 by a pin, and the other end portion installed to rotate around the link rotary shaft 64. The second link piece 66 has one end portion installed to rotate around the link rotary shaft 64. The third link piece 67 has one end portion coupled to the other end portion of the second link piece 66 by a pin, and the other end portion coupled to a portion of the movable ring 31 by a pin. The second link piece 66 is connected to the first link piece 65 to be integrally rotated therewith according to rotation of the first link piece 65 around the link rotary shaft 64 due to movement of the driving end 62 of the actuator 61.

In addition, the rotary drive mechanism 60 of each of the variable vane stages 16*a* to 16*d* may include the actuator 61 of each of the variable vane stages 16*a* to 16*d*, or two or more of the plurality of variable vane stages 16*a* to 16*d* may be set as one set, and the set may include one actuator 61. In this case, the respective rotary drive mechanisms 60 for one set of variable vane stages share one actuator 61, one first link piece 65 and one link rotary shaft 64, and include the second link piece 66 and the third link piece 67 at each of the plurality of variable vane stages constituting one set.

Figure 4:
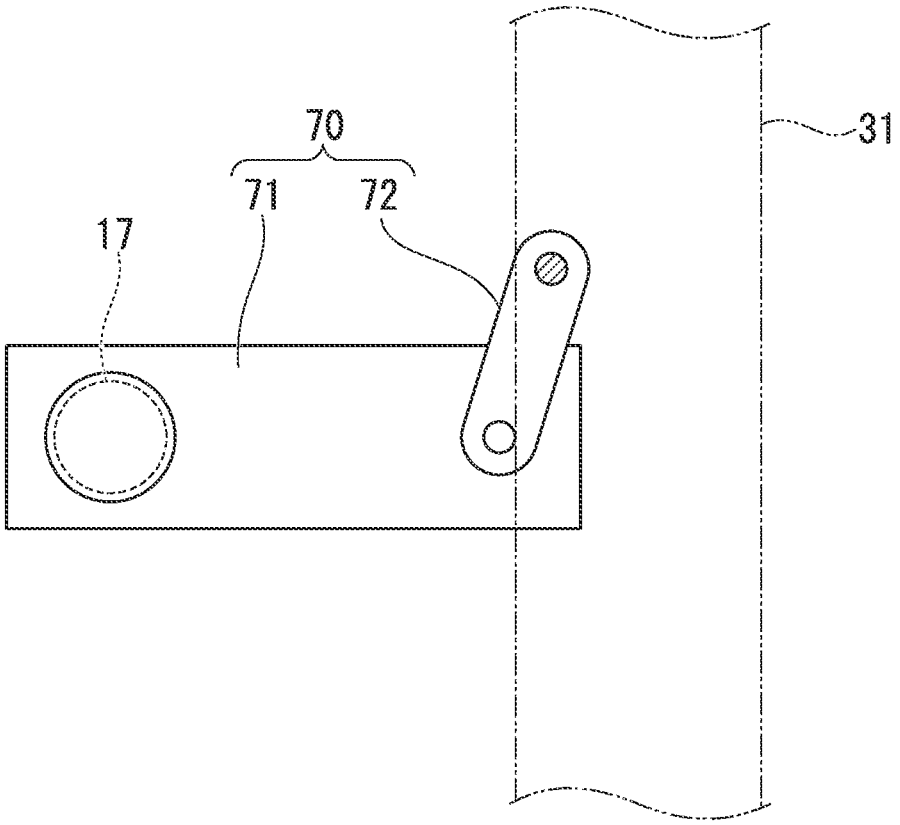
FIG. 4 is a view when seen from an arrow IV of FIG. 3.

As shown in FIGS. 3 and 4, the ring-blade link mechanism 70 of each of the variable vane stages 16*a* to 16*d* includes a first link piece 71, and a second link piece 72. The first link piece 71 is installed to be relatively non-rotatable with respect to the vane rotary shaft 17 of each of the variable vanes 16. The second link piece 72 has one end portion connected to the first link piece 71 by a pin, and the other end portion connected to the movable ring 31 by a pin.

As shown in FIG. 2, the variable vane drive device 30 includes four ring support mechanisms 40 disposed at regular intervals in the circumferential direction of the movable ring 31. Each of the ring support mechanisms 40 includes an inner roller 41*i*, an outer roller 41*o*, and a roller support base 43. The inner roller 41*i* is disposed at the inner circumferential side of the movable ring 31. The outer roller 41*o* is disposed at the outer circumferential side of the movable ring 31, and the movable ring 31 is sandwiched between the inner roller 41*i* and the outer roller 41*o*. The roller support base 43 rotatably supports the inner roller 41*i* and the outer roller 41*o* around axes Ai and Ao parallel to the rotor axis Ar in a state in which the movable ring 31 is sandwiched between the inner roller 41*i* and the outer roller 41*o*.

Further, as shown in FIG. 3, each of the ring support mechanisms 40 includes an inner roller position adjustment mechanism 44*i* and an outer roller position adjustment mechanism 44*o*. The inner roller position adjustment mechanism 44*i* varies a position of the axis Ai of the inner roller 41*i* in the radial direction around the rotor axis Ar. The outer roller position adjustment mechanism 44*o* varies a position of the axis Ao of the outer roller 41*o* in the radial direction with reference to the rotor axis Ar. In addition, as shown in FIG. 3, the movable ring 31 includes a movable ring main body 32 having an annular shape, an inner liner 32*i*, and an outer liner 32*o*. The inner liner 32*i* is fixed to an inner circumference of the movable ring main body 32 and in contact with the inner roller 41*i*. The outer liner 32*o* is fixed to an outer circumference of the movable ring main body 32 and in contact with the outer roller 41*o*.

Figure 5:
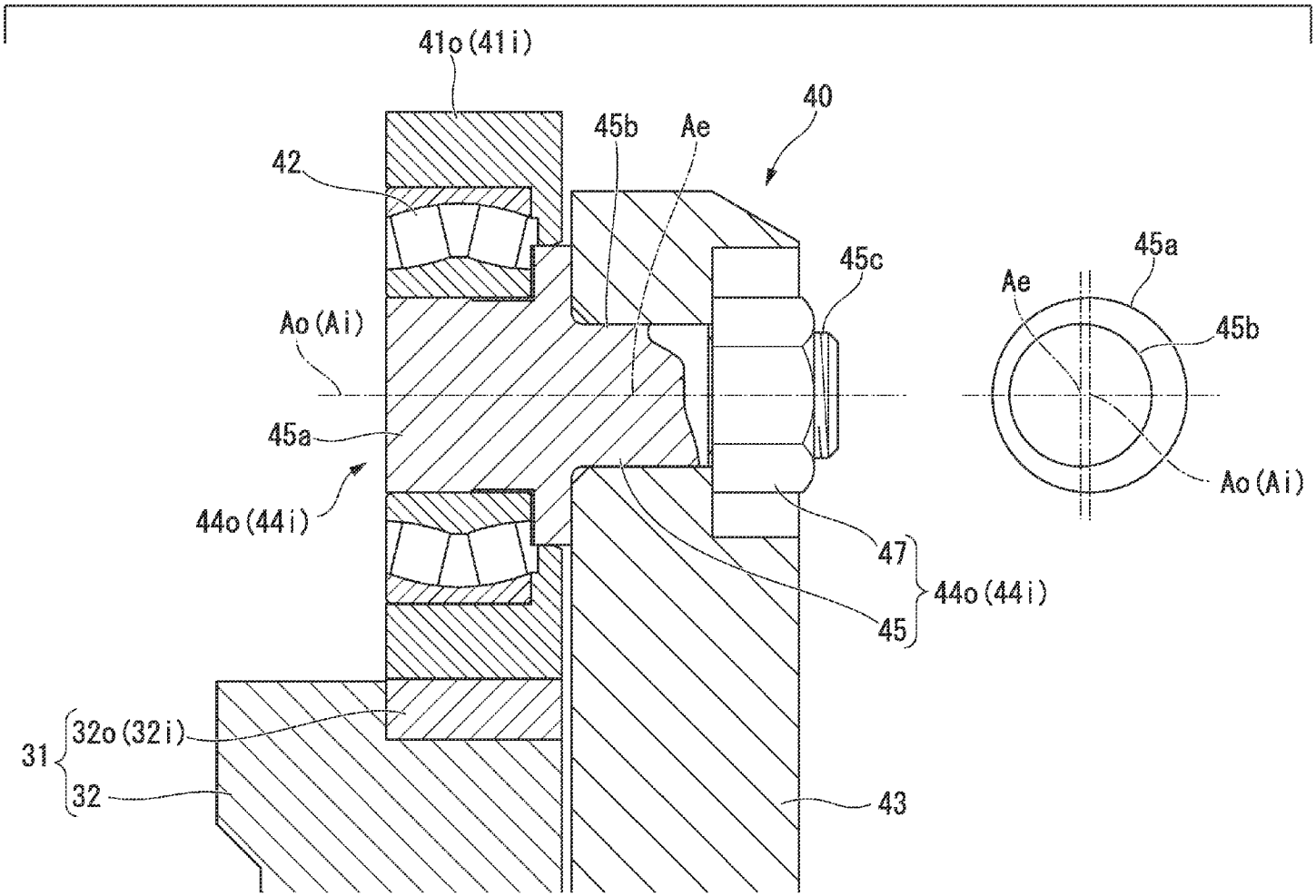
FIG. 5 is a cross-sectional view of major part of a ring support mechanism according to the embodiment of the present invention.

As shown in FIG. 5, the inner roller position adjustment mechanism 44*i* and the outer roller position adjustment mechanism 44*o* have a rotary shaft 45, and a fixing nut 47. The rotary shaft 45 rotatably supports a roller 41*o* (41*i*) via a bearing 42. The fixing nut 47 is installed as a fixing unit configured to restrict the rotary shaft 45 to be non-rotatable with respect to the roller support base 43. The rotary shaft 45 includes a roller attachment portion 45*a*, a supported portion 45*b*, and a threaded section 45*c*. The roller attachment portion 45*a* rotatably attaches the roller 41*o* (41*i*) via the bearing 42 around the axis Ao (Ai) of the roller 41*o* (41*i*). The supported portion 45*b* forms a cylindrical shape around an eccentric axis Ae deviated from the axis Ao (Ai), and is rotatably supported by the roller support base 43 around the eccentric axis Ae. The threaded section 45*c* is installed at an opposite side of the roller attachment portion 45*a* from the supported portion 45*b*, and the fixing nut 47 is screwed therein. In addition, as described above, the roller support base 43 rotatably supports the inner roller 41*i* and the outer roller 41*o* around the rotor axis Ar via the bearing 42 and the rotary shaft 45.

When the position of the axis Ao (Ai) of the roller 41*o* (41*i*) in the radial direction is varied with reference to the rotor axis Ar, the rotary shaft 45 is rotated around the eccentric axis Ae with respect to the roller support base 43 in a state in which the fixing nut 47 of the roller position adjustment mechanism 44*o* (44*i*) is loosened. Since the axis Ao (Ai) of the roller 41*o* (41*i*) is deviated from the eccentric axis Ae, a position in the radial direction is varied around the rotor axis Ar due to the rotation. Then, when the axis Ao (Ai) of the roller 41*o* (41*i*) is disposed at a desired position, the fixing nut 47 is threadedly engaged with the threaded section 45*c* of the rotary shaft 45, and the rotary shaft 45 is restricted to be non-rotatable with respect to the roller support base 43. That is, the position of the axis Ao (Ai) of the roller 41*o* (41*i*) is fixed.

In a final step of the installation of the variable vane drive device 30, positions of the inner roller 41*i* and the outer roller 41*o* are adjusted using the inner roller position adjustment mechanism 44*i* and the outer roller position adjustment mechanism 44*o* of each of the four ring support mechanisms 40.

Specifically, positions of the respective inner rollers 41*i* are adjusted using the inner roller position adjustment mechanisms 44*i* of the respective four ring support mechanisms 40 such that the four inner rollers 41*i* are inscribed in the movable ring 31. Further, positions of the respective outer rollers 41*o* are adjusted using the outer roller position adjustment mechanisms 44*o* of the respective four ring support mechanisms 40 such that the four outer rollers 41*o* circumscribe the movable ring 31. In addition, position adjustment of the inner roller 41*i* and the outer roller 41*o* may be performed after installation of the axial-flow compressor C, during inspection or the like of the axial-flow compressor C, as well as at the final step of the installation of the variable vane drive device 30.

In the axial-flow compressor C, in order to adjust a suction flow rate from the beginning of the startup to the shutdown of the axial-flow compressor C, vane angles of the first variable vane stage 16*a* to the fourth variable vane stage 16*d* are appropriately varied.

In the axial-flow compressor C, pressure of a gas gradually increases as it flows to a downstream side, and temperature of the gas increases. For this reason, a thermal expansion difference is generated between the casing 20 and the movable ring 31 due to a temperature difference between the casing 20 which is in direct contact with the gas and the movable ring 31 during a startup process and a shutdown process of the axial-flow compressor C. Specifically, during the startup process of the axial-flow compressor C, since a temperature increase of a portion supporting the movable ring 31 in the casing 20 is rapid compared with the movable ring 31, a casing diameter of the portion supporting the movable ring 31 with respect to the movable ring 31 is relatively increased. In addition, during the shutdown process of the axial-flow compressor C, since a temperature decrease of the portion supporting the movable ring 31 in the casing 20 is rapid compared with the movable ring 31, a casing diameter of the portion supporting the movable ring 31 with respect to the movable ring 31 is relatively decreased.

When a size of the casing diameter is relatively varied with respect to the diameter of the movable ring 31, the position of the axis of the movable ring 31 is deviated with respect to the axis of the casing 20, and vane angles of the plurality of variable vanes 16 become uneven. In addition, the axis of the casing 20 basically overlaps the rotor axis Ar.

However, in this embodiment, since the movable ring 31 is sandwiched between the inner roller 41*i* and the outer roller 41*o* of each of the four ring support mechanisms 40, a contact state between the movable ring 31 and all of the inner rollers 41*i* and all of the outer rollers 41*o* corresponding to the movable ring 31 is maintained regardless of the operating state of the axial-flow compressor C. Accordingly, the position of the axis of the movable ring 31 with respect to the axis of the casing 20 is not deviated.

As described above, in this embodiment, while the thermal expansion difference of the portion supporting the movable ring 31 in the casing 20 with respect to the movable ring 31 is generated, the position of the axis of the movable ring 31 with respect to the axis of the casing 20 is not deviated. However, since there is a thermal expansion difference, in this embodiment, a portion of the movable ring 31 which is not sandwiched between the inner roller 41*i* and the outer roller 41*o* is bent as shown in FIG. 2.

Specifically, in the startup process of the axial-flow compressor C, since the temperature increase of the portion supporting the movable ring 31 in the casing 20 is rapid compared with the movable ring 31, expansion of the casing 20 of the portion with respect to the movable ring 31 is increased. In other words, in the startup process of the axial-flow compressor C, the expansion of the movable ring 31 with respect to the casing 20 is relatively small. For this reason, in the startup process of the axial-flow compressor C, the portion of the movable ring 31 which is not sandwiched between the inner roller 41*i* and the outer roller 41*o* is bent in a direction approaching the casing 20 as shown in FIG. 2.

In addition, in the shutdown process of the axial-flow compressor C, since the temperature decrease of the portion supporting the movable ring 31 in the casing 20 is rapid compared with the movable ring 31, a shrinkage amount of the casing 20 of the portion with respect to the movable ring 31 is increased. For this reason, in the shutdown process of the axial-flow compressor C, the portion of the movable ring 31 which is not sandwiched between the inner roller 41*i* and the outer roller 41*o* is bent in a direction away from the casing 20.

As described above, since the portion of the movable ring 31 which is not sandwiched between the inner roller 41*i* and the outer roller 41*o* is bent according to the operating state of the axial-flow compressor C, when the driving end 62 of the actuator 61 is directly connected with the portion, the driving end 62 follows the bending and an unnecessary load is applied to the actuator 61. Here, in this embodiment, the driving end 62 of the actuator 61 is connected to the movable ring 31 for the second stage via the drive-ring link mechanism 63 so that the bending of the movable ring 31 can be absorbed by the drive-ring link mechanism 63.

However, when the number of ring support mechanisms 40 corresponding to the movable ring 31 is very large, reaction forces of the respective rollers 41*i* and 41*o* increase due to the bending of the movable ring 31. Specifically, from a structural point of view, since stiffness of a beam is in reverse proportion to a cube of a distance between two points supporting the beam, as described in this embodiment, when the number of the ring support mechanisms 40 is increased to reduce the distance between the ring support mechanisms 40, reaction forces of the respective rollers 41*i* and 41*o* increase in proportion to a cube of the distance. Accordingly, when the number of ring support mechanisms 40 is increased, reaction forces of the rollers 41*i* and 41*o* significantly increase, and thus stiffness of the rotary shaft 45 and the bearing 42 of the rollers 41*i* and 41*o* and further the roller support base 43 should be significantly enhanced. For this reason, the number of ring support mechanisms 40 for the movable ring 31 is preferably five or less.

Accordingly, the number of ring support mechanisms 40 with respect to the movable ring 31 is preferably four as in this embodiment, or five.

As described above, in this embodiment, since the movable ring 31 is sandwiched between the inner rollers 41*i* and the outer rollers 41*o* at multiple places, positional deviation of the axis of the movable ring 31 with respect to the axis of the casing 20 can be prevented regardless of the operating state of the axial-flow compressor C, and vane angles of the plurality of variable vanes 16 can always be uniformized.

In addition, in this embodiment, since the four ring support mechanisms 40 including the inner rollers 41*i* and the outer rollers 41*o* are installed, the necessity of extremely enhancing the stiffness and strength of the rotary shaft 45 or the bearing 42 and further the roller support base 43 of the ring support mechanism 40 can be avoided.

Figure 6A:
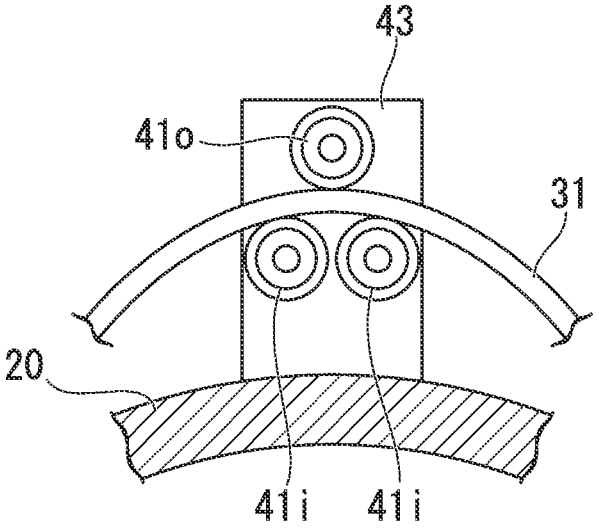
FIG. 6A is a view for describing a ring support mechanism according to a variant of the embodiment of the present invention, showing a ring support mechanism of a first variant.
Figure 6B:
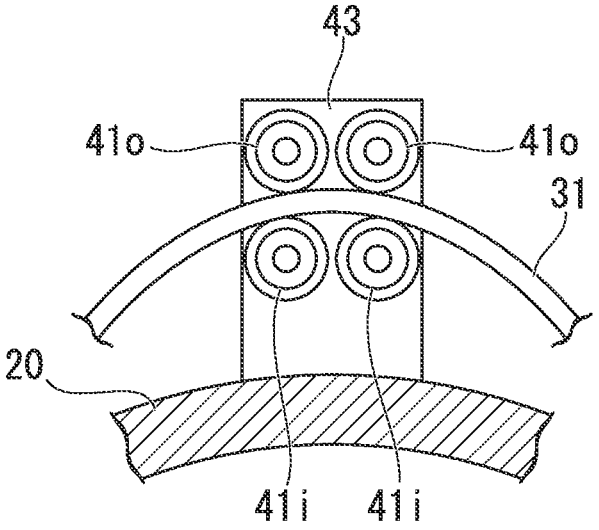
FIG. 6B is a view for describing a ring support mechanism according to a variant of the embodiment of the present invention, showing a ring support mechanism of a second variant.

Further, in the above-mentioned embodiment, in the ring support mechanism 40 for the movable ring 31, while the one inner roller 41*i* and the one outer roller 41*o* are installed at the one roller support base 43, as shown in FIGS. 6A and 6B, it is only necessary to install the plurality of inner rollers 41*i* and the plurality of outer rollers 41*o* in a configuration in which the movable ring 31 can be sandwiched therebetween. For example, two or more inner rollers 41*i* may be installed at one roller support base 43, or further, two or more outer rollers 41*o* may be installed at one roller support base 43.

Furthermore, in the above-mentioned embodiment, while a center distance adjustment mechanism for adjusting a distance between the axis of the inner roller 41*i* and the axis of the outer roller 41*o* using the inner roller position adjustment mechanism 44*i* and the outer roller position adjustment mechanism 44*o* is provided, the center distance adjustment mechanism may be constituted by any one position adjustment mechanism of the inner roller position adjustment mechanism 44*i* and the outer roller position adjustment mechanism 44*o*.

In addition, although configurations of the variable vane drive devices 30 of the respective variable vane stages 16*a* to 16*d* are the same as each other in the above-mentioned embodiment, the variable vane drive device of the first variable vane stage 16*a* may have a different configuration. Specifically, the portion of the casing 20 supporting the movable ring 31 of the first variable vane stage 16*a* has substantially the same temperature as an external air temperature regardless of the operating state of the axial-flow compressor C, because the non-compressed external air passes therethrough. That is, there is no substantial temperature difference between the movable ring 31 of the first variable vane stage 16*a* and the portion supporting the movable ring 31 in the casing 20 regardless of the operating state of the axial-flow compressor C, and the thermal expansion difference is not generated therebetween. For this reason, even when the movable ring 31 of the first variable vane stage 16*a* is supported by only the pluralities of inner rollers 41*i* or outer rollers 41*o*, when the movable ring 31 of the first variable vane stage 16*a* is in contact with all of the inner rollers 41*i* or all of the outer rollers 41*o* corresponding thereto before the startup of the axial-flow compressor C, a contact state between the movable ring 31 of the first variable vane stage 16*a* and all of the inner rollers 41*i* or all of the outer rollers 41*o* is maintained regardless of the operating state of the axial-flow compressor C. Accordingly, the position of the axis of the movable ring 31 with respect to the axis of the casing 20 is not deviated. Therefore, in the variable vane drive device of the first variable vane stage 16*a*, a configuration in which the movable ring 31 of the first variable vane stage 16*a* is supported by only the plurality of inner rollers 41*i* or outer rollers 41*o* may be employed.

In addition, in the above-mentioned embodiment, while the axial-flow compressor C is exemplified as the axial-flow fluid machine, the present invention is not limited thereto but may be applied to other axial-flow fluid machines such as a turbine or the like.

DESCRIPTION OF REFERENCE NUMERALS

10: rotor
11: rotor main body
12: blade
16: variable vane (vane)
20: casing
30: variable vane drive device
31: movable ring
40: ring support mechanism
41*i*: inner roller
41*o*: outer roller
43: roller support base
44*i*: inner roller position adjustment mechanism
44*o*: outer roller position adjustment mechanism
44: rotary shaft
45*a*: roller attachment portion
45*b*: supported portion
45*c*: threaded section
47: fixing nut
60: rotary drive mechanism
61: actuator
62: driving end
63: drive-ring link mechanism
70: ring-blade link mechanism

What is claimed is:

1. A variable vane drive device of an axial-flow fluid machine with a rotor having a plurality of blades, a casing which rotatably houses the rotor, and a plurality of variable vanes annularly arranged around the rotor on the inside of the casing, the variable vane drive device of the axial-flow fluid machine comprising:

a movable ring disposed at an outer circumferential side of the casing and having an annular shape;

a plurality of ring support mechanisms which are disposed at intervals along a circumferential direction of the movable ring and rotatably support the movable ring around a rotor axis of the rotor;

a rotary drive mechanism which rotates the movable ring around the rotor; and a link mechanism which connects the movable ring to the variable vane such that an angle of the variable vane is varied by rotation of the movable ring, wherein each of the plurality of ring support mechanisms comprises:

an inner roller which is disposed at an inner circumferential side of the movable ring;

an outer roller which is disposed at an outer circumferential side of the movable ring, the movable ring being sandwiched between the inner roller and the outer roller; and a roller support base, which is connected to the casing, and having an assembly including both the inner roller and the outer roller, and rotatably supports the inner roller and the outer roller around an axis parallel to the rotor in a state in which the movable ring is sandwiched between the inner roller and the outer roller and maintains contact therebetween, wherein the inner roller and the outer roller are disposed so as to be close to each other and along the circumferential direction of the movable ring in a state in which the movable ring is sandwiched between the inner roller and the outer roller, and wherein each of the plurality of ring support mechanisms has a center distance adjustment mechanism which adjusts a distance between the axis of the inner roller and the axis of the outer roller.

2. The variable vane drive device of the axial-flow fluid machine according to claim 1, wherein the center distance adjustment mechanism is a mechanism that varies at least one axis position of one roller of the inner roller and the outer roller, and comprises a rotary shaft that rotatably supports the one roller, wherein the rotary shaft comprises:

a roller attachment portion to which the one roller is rotatably attached around the axis of the one roller; and a supported portion which forms a cylindrical shape around an eccentric axis deviated from the axis of the one roller and is rotatably supported by the roller support base around the eccentric axis.

3. The variable vane drive device of the axial-flow fluid machine according to claim 1, wherein the rotary drive mechanism has an actuator having a driving end that linearly reciprocates, and a link mechanism which connects the driving end to the movable ring.

4. The variable vane drive device of the axial-flow fluid machine according to claim 1, wherein four or five ring support mechanisms are provided.

5. The variable vane drive device of the axial-flow fluid machine according to claim 1, wherein each of the plurality of ring support mechanisms comprises a plurality of the inner rollers provided in the roller support base.

6. The variable vane drive device of the axial-flow fluid machine according to claim 5, wherein each of the plurality of ring support mechanisms comprises a plurality of the outer rollers provided in the roller support base.

7. An axial-flow fluid machine comprising:

a rotor having a plurality of blades;

a casing that rotatably houses the rotor;

a plurality of variable vanes annularly disposed around the rotor on the inside of a casing; and a variable vane drive device which comprises:

a moveable ring disposed at an outer circumferential side of the casing and having an annular shape, a plurality of ring support mechanisms which are disposed at intervals along a circumferential direction of the moveable ring and rotatably support the movable ring around a rotor axis of the rotor, a rotary drive mechanism which rotates the movable ring around the rotor, and a link mechanism which connects the movable ring to the variable vane such that an angle of the variable vane is varied by rotation of the movable ring, wherein each of the plurality of ring support mechanisms comprises:

an inner roller which is disposed at an inner circumferential side of the movable ring;

an outer roller which is disposed at an outer circumferential side of the moveable ring, the movable ring being sandwiched between the inner roller and the outer roller; and a roller support base, which is connected to the casing, and having an assembly including both the inner roller and the outer roller, and rotatably supports the inner roller and the outer roller around an axis parallel to the rotor in a state in which the movable ring is sandwiched between the inner roller and the outer roller and maintains contact therebetween, wherein the inner roller and the outer roller are disposed so as to be close to each other and along the circumferential direction of the movable ring in a state in which the movable ring is sandwiched between the inner roller and the outer roller, and wherein each of the plurality of ring support mechanisms has a center distance adjustment mechanism which adjusts a distance between the axis of the inner roller and the axis of the outer roller.

* * * * *